US008200133B2

(12) United States Patent
Iwasaki

(10) Patent No.: US 8,200,133 B2
(45) Date of Patent: Jun. 12, 2012

(54) IMAGE FORMING APPARATUS

(75) Inventor: Hiroyuki Iwasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 401 days.

(21) Appl. No.: 12/461,155

(22) Filed: Aug. 3, 2009

(65) Prior Publication Data

US 2010/0028028 A1 Feb. 4, 2010

(30) Foreign Application Priority Data

Aug. 1, 2008 (JP) ..... 2008-200038
Jul. 17, 2009 (JP) ..... 2009-168442

(51) Int. Cl.
*G03G 15/01* (2006.01)

(52) U.S. Cl. ..... 399/298; 399/167; 399/302; 399/303

(58) Field of Classification Search ..... 399/302, 399/177, 167, 303, 308, 298, 313, 312, 162, 399/159; 347/261
See application file for complete search history.

(56) References Cited

U.S. PATENT DOCUMENTS 7,054,586 B2 5/2006 Kuroda
7,228,095 B2 6/2007 Kuroda
7,280,789 B2 10/2007 Iwasaki
7,558,510 B2 7/2009 Iwasaki
2004/0113581 A1* 6/2004 Kobayashi et al.
2007/0059054 A1* 3/2007 Furukawa ..... 399/302
2008/0056741 A1 3/2008 Iwasaki
2010/0008689 A1 1/2010 Iwasaki et al.

FOREIGN PATENT DOCUMENTS

JP 2002-258580 9/2002
JP 2004-317739 11/2004
JP 2006-139063 6/2006
JP 2006-171233 6/2006

* cited by examiner

*Primary Examiner* — Susan Lee
(74) *Attorney, Agent, or Firm* — Harness, Dickey & Pierce, P.L.C.

(57) ABSTRACT

A tandem-type image forming apparatus in which a photoreceptor for black is controlled to be contacted to an intermediate transfer member and the photoreceptors for colors are controlled to be separated from the intermediate transfer member in a case of forming a black and white image, is disclosed, including a current control part which controls so that in the case of forming the black and white image, when the intermediate transfer member is driven, a value of a current flowing to the motor is equal to the value of the current in the case of forming the color image. The current control part controls the value of the current by controlling a rotational velocity of the photoreceptor for black.

10 Claims, 8 Drawing Sheets

IMAGE FORMING APPARATUS

BACKGROUND OF THE INVENTION

1. Field of the Invention

The present invention is related to a technology of an image forming apparatus, and more particularly to the technology for making load torque of a motor driving an intermediate transfer member or a transfer belt not be reduced when photoreceptors for colors are separated from the intermediate transfer member or the transfer belt.

2. Description of the Related Art

Recently, the number of electrophotographic devices, which includes a color printing function such as a color copier, a color printer, or a like, has increased.

Among others, the number of tandem type of the electrophotographic devices has increased in which a developing device is individually provided to each of a plurality of photoreceptors. Single toner images are formed on respective photoreceptors, and then sequentially transfer the single toner images to an intermediate transfer member (belt), and transfer a synthetic color image onto a sheet. In this case, in order to improve a life duration of the photoreceptors for colors, Japan Laid-open Patent No. 2006-139063 and a like disclose the photoreceptors other than photoreceptors for black and white are separated from the intermediate transfer member when a black and white image is formed. The intermediate transfer member is driven by a motor. The load torque for the motor driving the intermediate transfer member is different between a case of forming a color image and a case of forming the black and white image, depending on the number of the photoreceptors contacting with the intermediate transfer member.

Accordingly, in the black and white image formation, a torque for the motor is lower than a torque for the motor while conducting the color image formation, and there is a problem in that a stable motor control becomes difficult.

SUMMARY OF THE INVENTION

The present invention solves or reduces one or more of the above problems.

In an aspect of this disclosure, there is provided a tandem-type image forming apparatus including a photoreceptor for black which is rotatable, a plurality of photoreceptors for colors which is rotatable, an intermediate transfer member or a transfer belt, the intermediate transfer member which is an endless belt shape and transfers a toner image formed on the photoreceptors, the transfer belt which is an endless belt shape and carries a printing medium to transfer the toner image, and a motor which drives the intermediate transfer member or the transfer belt, in which the photoreceptor for black and the plurality of the photoreceptors for colors are controlled to be contacted to the intermediate transfer member or the transfer belt in a case of forming a color image, and in which the photoreceptor for black is controlled to be contacted to the intermediate transfer member or the transfer belt and the plurality of the photoreceptors for colors are controlled to be separated from the intermediate transfer member or the transfer belt in a case of forming a black and white image, the tandem-type image forming apparatus including: a current control part configured to control so that in the case of forming the black and white image, when the intermediate transfer member or the transfer belt is driven, a value of a current flowing to the motor is equal to the value of the current in the case of forming the color image, wherein the current control part controls the value of the current by controlling a rotational velocity of the photoreceptor for black.

In another aspect of this disclosure, there is provided a tandem-type image forming apparatus including a photoreceptor for black which is rotatable, a plurality of photoreceptors for colors which is rotatable, an intermediate transfer member which is an endless belt shape and transfers a toner image formed on the photoreceptors, a motor which drives the intermediate transfer member, a polygon mirror which is rotatable and reflects a laser light to scan the photoreceptors and to form an electrostatic latent image on the photoreceptors, and a transfer belt which caries a printing medium when the toner image transferred onto the intermediate transfer member is secondarily transferred onto the printing medium, in which the photoreceptor for black and the plurality of the photoreceptors for colors are controlled to be contacted to the intermediate transfer member in a case of forming a color image, and in which the photoreceptor for black is controlled to be contacted to the intermediate transfer member and the plurality of the photoreceptors for colors are controlled to be separated from the intermediate transfer member in a case of forming a black and white image, the tandem-type image forming apparatus including: a current control part configured to control so that in the case of forming the black and white image, when the intermediate transfer member is driven, a value of a current flowing to the motor is equal to the value of the current in the case of forming the color image, wherein the current control part controls the value of the current by controlling a transfer velocity of the transfer belt and a rotational velocity of the polygon mirror. In a further aspect of this disclosure, there is provided a tandem-type image forming apparatus including a photoreceptor for black which is rotatable, a plurality of photoreceptors for colors which is rotatable, a transfer belt which is an endless belt shape and carries a printing medium to transfer a toner image formed on the photoreceptors, a motor which drives the transfer belt, and a polygon mirror which is rotatable and reflects a laser light to scan the photoreceptors and to form an electrostatic latent image on the photoreceptors, in which the photoreceptor for black and the plurality of the photoreceptors for colors are controlled to be contacted to the transfer belt in a case of forming a color image, and in which the photoreceptor for black is controlled to be contacted to the transfer belt and the plurality of the photoreceptors for colors are controlled to be separated from the transfer belt in a case of forming a black and white image, the tandem-type image forming apparatus including: a current control part configured to control so that in the case of forming the black and white image, when the transfer belt is driven, a value of a current flowing to the motor is equal to the value of the current in the case of forming the color image, wherein the current control part controls the value of the current by controlling a driving velocity of the transfer belt by the motor and a rotational velocity of the polygon mirror.

Accordingly, it is possible to provide the image forming apparatus which can stably rotate and drive the motor driving the intermediate transfer member or the transfer belt and can form a high quality image, even in the case of forming the black and white image in which the photoreceptors for colors are separated from the intermediate transfer member or the transfer belt.

BRIEF DESCRIPTION OF THE DRAWINGS

In the following, embodiments of the present invention will be described with reference to the accompanying drawings.

DESCRIPTION OF THE PREFERRED EMBODIMENT

In the following, an embodiment of the present invention to will be described with reference to the accompanying drawings.

<Brief Overview of Image Forming Apparatus>

Figure 1:
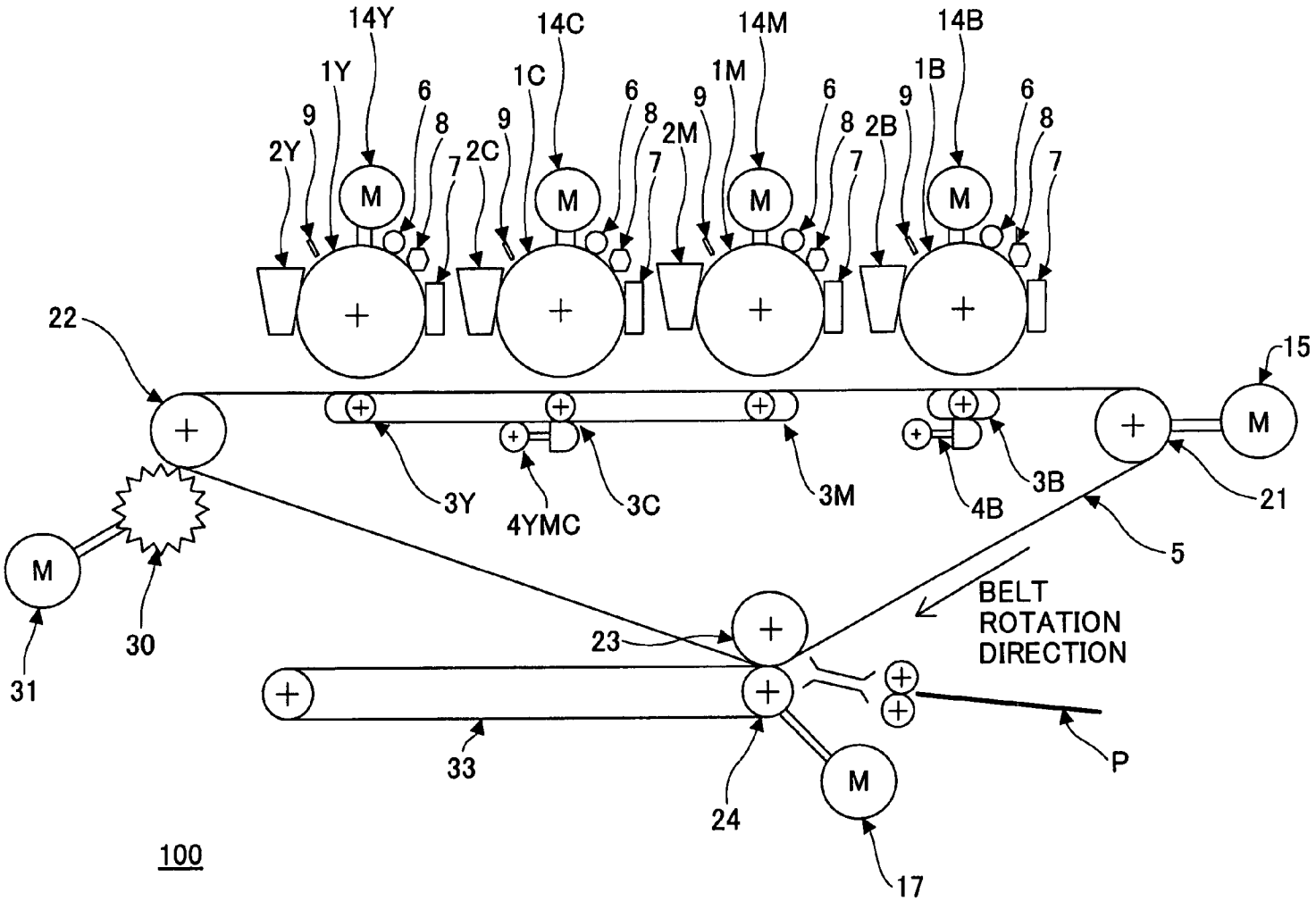
FIG. 1 is a diagram illustrating an example of an image forming apparatus of an intermediate transfer system according to an embodiment.

A brief overview of image forming apparatuses according to the present invention will be described with reference to FIG. 1 and FIG. 2. FIG. 1 is a diagram illustrating a schematic configuration of an image forming apparatus of an intermediate transfer system according to an embodiment.

As illustrated in FIG. 1, an image forming apparatus 100 according to the present invention includes developing devices 2Y, 2C, 2M, and 2B (hereinafter, simply called developing devices 2 if not necessary to specify), and transfer devices 3Y, 3C, 3M, and 3B (hereinafter, simply called transfer devices 3 if not necessary to specify), respectively for a plurality of photoreceptors 1Y, 1C, 1M, and 1B (hereinafter, simply called photoreceptors 1 if not necessary to specify). The photoreceptors 1Y, 1C, 1M, and 1B are driven by corresponding control motors 14Y, 14C, 14M, and 14B. In the image forming apparatus 100, toner images corresponding to single colors are formed on respective photoreceptors 1. The toner images for the single colors are contacted to an intermediate transfer member (an intermediate transfer belt) 5, and are sequentially transferred onto the intermediate transfer member 5. Then, a synthetic color image is formed. Moreover, the image forming apparatus 100 is an electrophotographic device (a color copier or a color printer) being a tandem type in which a color image can be formed by collectively transferring a formed synthetic color image to a printing medium P of a sheet.

The photoreceptors 1Y, 1C, 1M, and 1B being a drum shape are rotatable image carriers being separately independent in which different toner images are formed on their surfaces. Thus, each of toner images formed on respective photoreceptors 1 is formed on the intermediate transfer member 5 moving rotationally at transfer positions corresponding to the photoreceptors 1. Since the image forming apparatus 100 transfers a toner image on each of the photoreceptors 1 onto the intermediate transfer member 5, the image forming apparatus 100 operates the transfer devices (transfer rollers) 3Y, 3C, 3M, and 3B upward and downward as appropriate. The transfer devices 3 can be positioned up and down by moving contact/separation mechanisms 4YMC and 4B. Thus, it is possible to make a contact or a separation between the photoreceptors 1Y, 1C, 1M, and 1B and the intermediate transfer member 5.

Moreover, in addition to the developing devices 2, charging devices 6, cleaning devices 7, charge eliminating devices 8, and the like are circumferentially provided for the corresponding photoreceptors 1. In each of the photoreceptors 1, a laser light corresponding to an image of a respective color is scanned from a laser writing part 9 based on an image signal. Electrostatic latent images are formed on the photoreceptors 1Y, 1C, 1M, and 1B, respectively.

Figure 2:
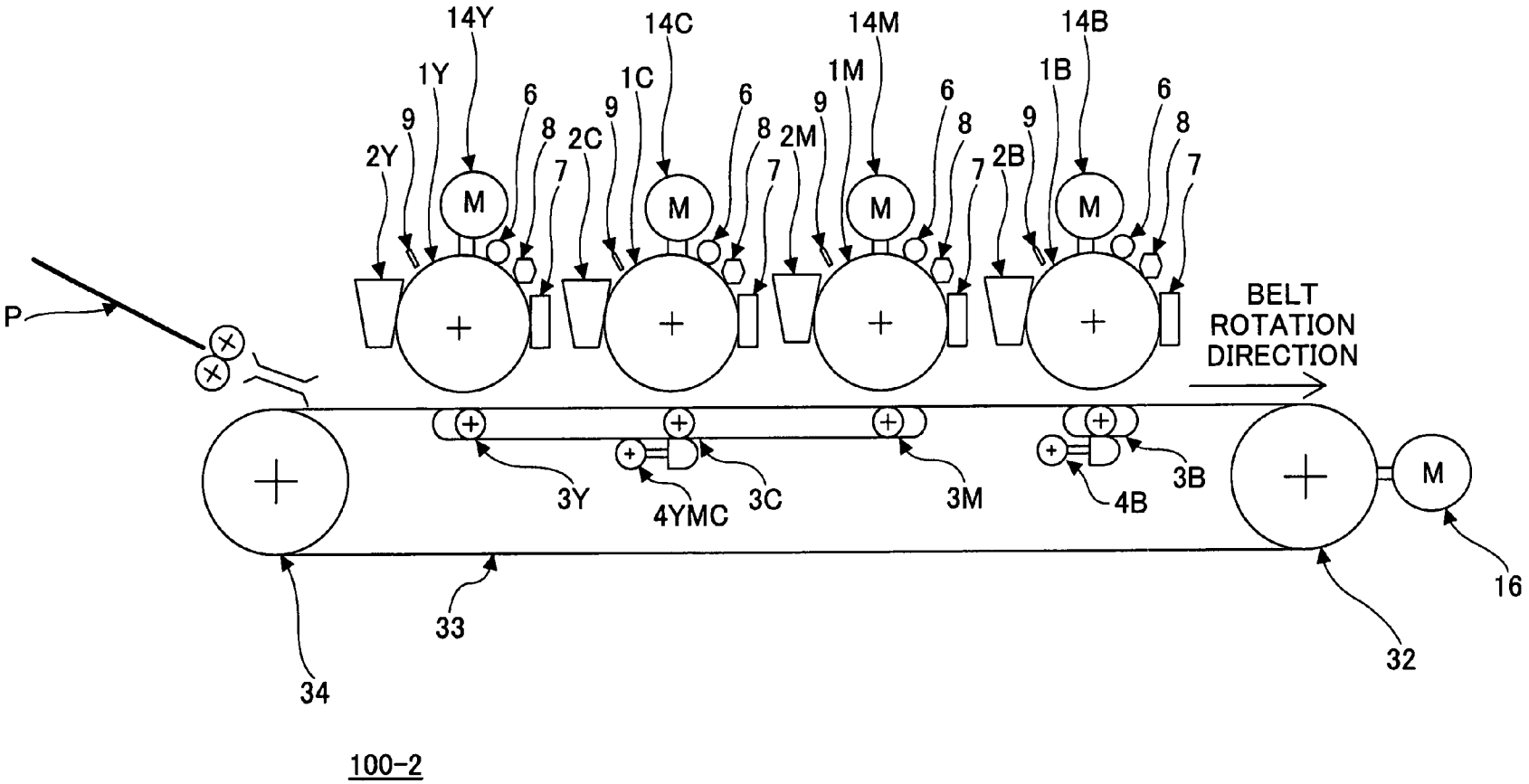
FIG. 2 is a diagram illustrating an example of an image forming apparatus of a direct transfer system according to an embodiment.

FIG. 2 is a diagram illustrating a schematic configuration of an image forming apparatus 100-2 of a direct transfer system which directly transfers toner images on the photoreceptors 1Y, 1C, 1M, and 1B to the printing medium P. In FIG. 2, parts that are the same as those shown in FIG. 1 are given the same reference numbers.

In the image forming apparatus 100-2 of the direct transfer system, mechanisms for generating toner images on the photoreceptors 1Y, 1C, 1M, and 1B and of transferring the generated toner images to the printing medium P are the same as the image forming apparatus 100 of an intermediate transfer system. Also, in the image forming apparatus 100-2 of the direct transfer system, the transfer devices (transfer rollers) 3Y, 3C, 3M, and 3B are positioned up and down by moving the contact/separation mechanisms 4YCM, and 4B. By this operation, a contact and a separation can be made between a transfer belt 33 for transferring the printing medium P and the photoreceptors 1Y, 1C, 1M, and 1B. Moreover, the transfer belt 33 is stretched between a driving roller 32 being rotationally driven by a control motor 16 and a driven roller 34, and rotationally moves in a belt rotation direction illustrated in FIG. 2.

Image forming operations in the image forming apparatus 100 of the intermediate transfer system and the image forming apparatus 100-2 of the direct transfer system are the same as an image forming operation of a well-known color image forming apparatus, and the explanation thereof will be omitted.

<Operation Principle of Image Forming Apparatus>

Figure 3A:
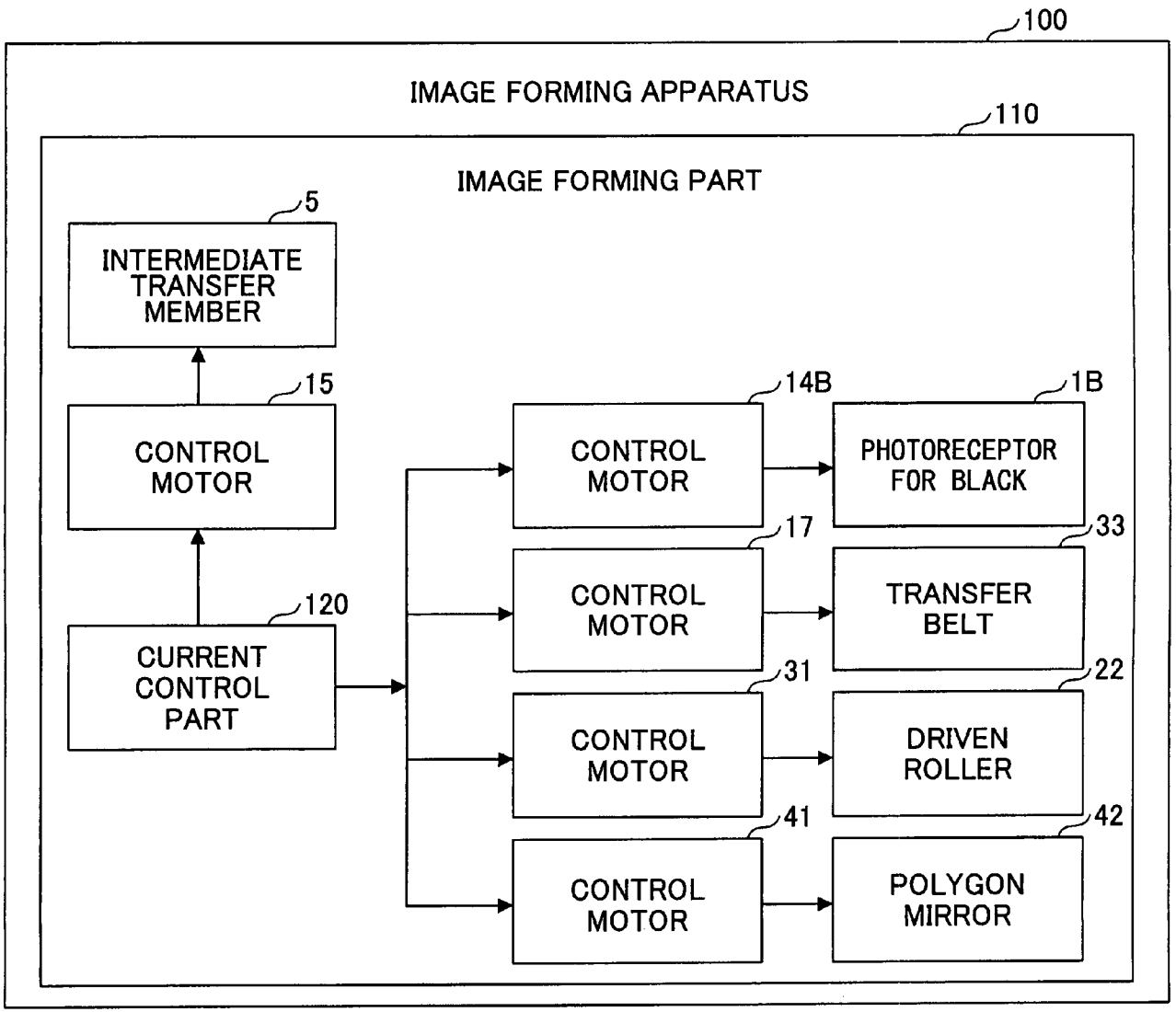
FIG. 3A is a diagram for explaining an operation principle of the image forming apparatus of the intermediate transfer system according to the embodiment.

An operation principle of the image forming apparatus 100 of the intermediate transfer system according to this embodiment will be described with reference to FIG. 3A. FIG. 3A is a diagram for explaining the operation principle of the image forming apparatus 100 of the intermediate transfer system.

As illustrated in FIG. 3A, the image processing apparatus 100 includes an image forming part 110. The image forming part 110 is a part to realize functions of forming a regular color image and/or a regular black and white image. For example, the image forming part 110 realizes a copier function for forming a color image or a black and white image on a sheet from image data which are acquired by scanning a manuscript by a scanner and outputting the sheet, a facsimile function for forming a color image or a black and white image on a sheet from image data which are received through a telephone line and outputting the sheet, and a printer function for forming a color image or a black and white image on a sheet from image data which are received through a LAN (Local Area Network) and outputting the sheet.

Also, the image forming part 110 in the image forming apparatus 100 of the intermediate transfer system includes a current control part 120, an intermediate transfer member 5, a control motor 15 for activating a roller 21 to drive the intermediate transfer member 5, the photoreceptor 1B for black, the control motor 14B for activating the photoreceptor 1B for black, a transfer belt 33, a control motor 17 for activating a roller 24 to drive the transfer belt 33, a driven roller 22, a control motor 31 for activating the driven roller 22, a polygon mirror 42, and a control motor 41 for activating the polygon mirror 42.

In the image forming apparatus 100 of the intermediate transfer system, the transfer belt 33 carries the printing medium P (a paper sheet or a like) to which a toner image on the intermediate transfer member 5 is secondarily transferred at a secondary transfer roller 23 (FIG. 1).

The polygon mirror 42 scans the corresponding photoreceptors 1 by reflecting a laser light, and forms electrostatic latent images on the corresponding photoreceptors 1. The polygon mirror 42 is rotated by the control motor 41.

On one hand, when a color image is formed, the image forming part 110 forms the color image by controlling so that the photoreceptors 1Y, 1C, 1M, and 1B are contacted to the intermediate transfer member 5. On the other hand, when a black and white image is formed, the image forming part 110 forms the black and white image by controlling so that the photoreceptor 1B for black is contacted to the intermediate transfer member 5 and the photoreceptors 1Y, 1C, and 1M for colors are separated from the intermediate transfer member 5.

The current control part 120 controls a value of a current flowing to the control motor 15 when the black and white image is formed, so that the value of the current flowing to the control motor 15 when the black and white image is formed becomes equal to a value of the current flowing to the control motor 15 when the color image is formed. An object of the present invention can be achieved if both of the values of the current are approximately equal to each other even though both of the values of the current do not become equal to each other.

Figure 3B:
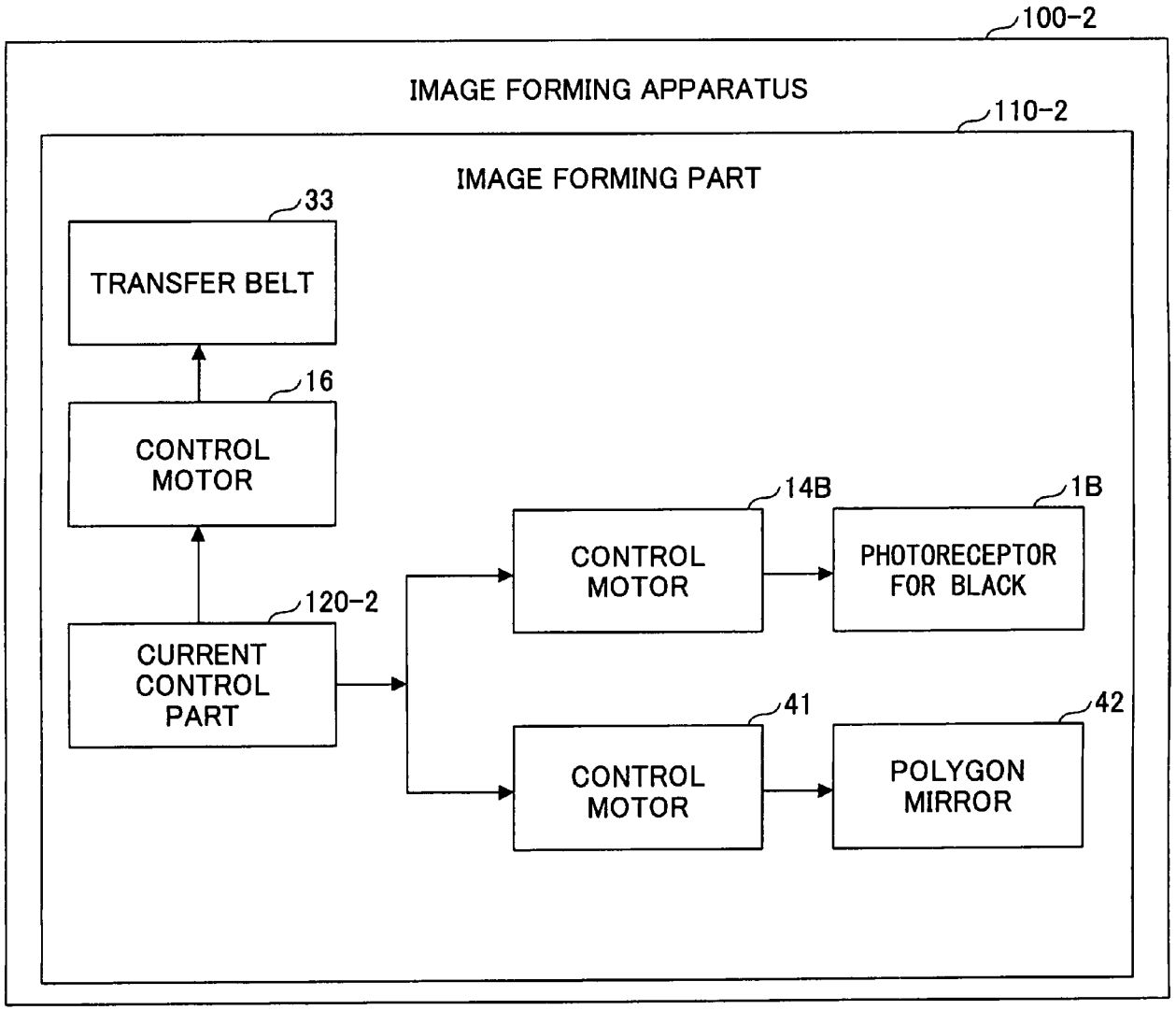
FIG. 3B is a diagram for explaining an operation principle of the image forming apparatus of the direct transfer system according to the embodiment.

An operation principle of the image forming apparatus 100-2 of the direct transfer system according to this embodiment will be described with reference to FIG. 3B. FIG. 3B is a diagram for explaining the operation principle of the image forming apparatus 100-2 of the direct transfer system.

As illustrated in FIG. 3B, the image processing apparatus 100-2 includes an image forming part 110-2. The image forming part 110-2 is a part to realize functions of forming a regular color image and/or a regular black and white image. For example, the image forming part 110-2 realizes a copier function, a facsimile function, and a printer function, similar to the image forming part 110 in the intermediate transfer system.

Also, the image forming part 110-2 in the image forming apparatus 100-2 of the direct transfer system includes a current control part 120-2, a transfer belt 33, a control motor 16 for activating the transfer belt 33, a photoreceptor 1B for black, a control motor 14B for activating the photoreceptor 1B for black, a polygon mirror 42, and a control motor 41 for activating the polygon mirror 42.

In the image forming apparatus 100-2 of the direct transfer system, the transfer belt 33 carries the printing medium P to which a toner image on the photoreceptor 1B for black is directly transferred.

On one hand, when a color image is formed, the image forming part 110-2 controls so that the photoreceptors 1Y, 1C, 1M, and 1B are contacted to the transfer belt 33, and forms the color image. On the other hand, when a black and white image is formed, the image forming part 110-2 controls so that the photoreceptor 1B for black is contacted to the transfer belt 33 and the photoreceptors 1Y, 1C, and 1M are separated from the transfer belt 33, and forms the color image.

The current control part 120-2 controls a value of a current flowing to the control motor 16, when the black and white image is formed, so that the value of the current flowing to the control motor 16 when the black and white image is formed becomes equal to a value of the current flowing to the control motor 16 when the color image is formed. An object of the present invention can be achieved if both of the values of the current are approximately equal to each other even though both of the values of the current do not become equal to each other.

In the following, a process of the current control part 120 in the image forming apparatus 100 of the intermediate transfer system will be described. The number of the photoreceptors 1 contacting to the intermediate member 5 is four when the color image is formed. On the other hand, the number of the photoreceptors 1 contacting to the intermediate member 5 is one when the black and white image is formed. Accordingly, frictional force acting onto the intermediate transfer member 5 (load torque with respect to the control motor 15) by the photoreceptors 1 in a case of forming the black and white image becomes smaller than frictional force in a case of forming the color image. Thus, in order to control so that the value of the current flowing to the control motor 15 becomes the same value in both cases in that the black and white image is formed and in that the color image is formed, the current control part 120 conducts a velocity control which will be described in the following, and increases the frictional force with respect to the intermediate transfer member 5 (load torque with respect to the control motor 15).

In one aspect, the current control part 120 increases the frictional force acting to the intermediate transfer member 5 by the photoreceptor 1B for black, by controlling the control motor 14B which rotationally drives the photoreceptor 1B for black. In detail, the current control part 120 controls the control motor 14B, and makes a rotational velocity of the photoreceptor 1B for black be a predetermined velocity Vb which is slower than a rotational velocity in a case of forming the color image. The predetermined velocity Vb is determined by torque of the control motor 15 and a range of allowable deterioration of image quality which is caused by making the rotational velocity of the photoreceptor 1B for black slower. By this control, it is possible to increase the frictional force acting to the intermediate transfer member 5 (load torque with respect to the control motor 15) by the photoreceptor 1B in the transfer device 3B.

Moreover, in a sub-scan direction of the toner image formed on the photoreceptor 1B for black, shrinkage caused by making the rotational velocity of the photoreceptor 1B for black slower is offset (enlarged) when the toner image is transferred onto the intermediate transfer member 5. Thus, the toner image transferred onto the intermediate transfer member 5 becomes a desired image. Alternatively, in this aspect, the current control part 120 may decrease the frictional force acting to the intermediate transfer member 5 by the photoreceptor 1B for black, by controlling the control motor 14B rotationally driving the photoreceptor 1B for the black. In detail, the current control part 120 controls the control motor 14B, and sets the rotational velocity of the photoreceptor 1B for black to be the predetermined velocity Vb which is faster than the rotational velocity in the case of forming the color image. In this case, in the sub-scan direction of the toner image formed on the photoreceptor 1B for black, elongation caused by making the rotational velocity of the photoreceptor 1B for black faster is offset (shrunk) when the toner image is transferred onto the intermediate transfer member 5.

Moreover, in another aspect, the current control part 120 increases the frictional force acting to the intermediate transfer member 5 by the photoreceptor 1B for black, by controlling the control motor 15 rotationally driving the intermediate transfer member 5. In detail, the current control part 120 controls the control motor 15, and makes the rotational velocity of the intermediate transfer member 5 be a predetermined velocity Vm which is faster than the rotational velocity in the case of forming the color image. The predetermined velocity Vm is determined by the torque of the control motor 15 and a range of allowable of deterioration of image quality which is caused by the control motor 15 which makes the rotational velocity of the transfer member 5 faster. By this control, it is possible to increase the frictional force acting to the intermediate transfer member 5 by the photoreceptor 1B for black (the load torque with respect to the control motor 15) in the transfer device 3B. Moreover, in the sub-scan direction of the toner image formed on the intermediate transfer member 5, the elongation caused by making the rotational velocity of the intermediate transfer member 5 faster is offset (shrunk) when the toner image is secondary transferred. Thus, the toner image transferred onto the printing medium P becomes a desired image.

Moreover, in the another aspect, the current control part 120 increases the frictional force acting to the intermediate transfer member 5 by the transfer belt 33, by controlling the control motor 17 rotationally driving the transfer belt 33 and the control motor 41 rotationally driving the polygon mirror 42. In detail, the current control part 120 controls the control motor 17, and makes the rotational velocity of the transfer belt 33 be a predetermined velocity Vs which is slower than the rotational velocity in the case of forming the color image. Simultaneously, the current control part 120 controls the control motor 41, and makes the rotational velocity of the polygon mirror 42 be a predetermined velocity Vp which is faster than the rotational velocity in the case of forming the color image. The predetermined velocities Vs and Vp are determined by the torque of the control motor 15 and a range of allowable deterioration of image quality which is caused by making the rotational velocity of the transfer belt 33 slower. By this control, it is possible to increase the frictional force acting to the intermediate transfer member 5 by the transfer belt 33 (the load torque with respect to the control motor 15). Also, in the sub-scan direction of the toner image which is to be transferred onto the printing medium P, the shrinkage caused by making the rotational velocity of the transfer belt 33 slower is offset (enlarged) by making a scan velocity of the polygon mirror 42 slower. Thus, the toner image transferred onto the printing medium P becomes the desired image.

Also, in a relationship between the predetermined velocities Vs and Vp, absolute values of change rates, in which each of the rotational velocities in forming the color image is set as a reference, are equal to each other. Alternatively, in this aspect, the current control part 120 may decrease the friction force acting to the intermediate transfer member 5 by the transfer belt 33, by controlling the control motor 17 rotationally driving the transfer belt 33 and the control motor 41 rotationally driving the control motor 17 and the polygon mirror 42. In detail, the current control part 120 controls the control motor 17, and makes the rotational velocity of the transfer belt 33 be a predetermined velocity Vs which is faster than the rotational velocity in the case of forming the color image. Simultaneously, the current control part 120 controls the control motor 41, and makes the rotational velocity of the polygon mirror 42 be a predetermined velocity Vp which is slower than the rotational velocity in the case of forming the color image. In this case, in the sub-scan direction of the toner image, the elongation caused by increasing the rotational velocity of the transfer belt 33 is offset (shrunk) due to a decrease of the scan velocity of the polygon mirror 42.

In another aspect, the current control part 120 directly increases the frictional force acting to the intermediate transfer member 5 by the driven roller 22, by controlling the control motor 31 which is additionally provided to the driven roller 22 rotationally driving the intermediate transfer member 5. In detail, the current control part 120 controls the control motor 31, and applies a load (brake) to a rotation of the driven roller 22. The control motor 31 may be directly connected to the driven roller 22. Alternatively, in order to be approximately the same as the load torque of the control motor 15 in the case of forming the color image, the control motor 31 may be connected to the driven roller 22 through a gear 30. Therefore, it is possible to increase the load torque which the control motor 15 receives, to be the same as a level of forming the color image. By this control, the shrinkage in the sub-scan direction of the toner image formed on the intermediate transfer member 5 is offset (enlarged) when the toner image is secondarily transferred onto the printing medium P. Thus, the toner image transferred onto the printing medium P becomes the desired image.

Next, a process of the current control part 120-2 in the image forming apparatus 100-2 of the direct transfer system will be described. The number of the photoreceptors 1 contacting to the transfer belt 33 is four when the color image is formed. On the other hand, the number of the photoreceptors 1 contacting to the transfer belt 33 is one when the black and white image is formed. Accordingly, the frictional force acting to the transfer belt 33 by the photoreceptors 1 in the case of forming the black and white image becomes smaller than the frictional force in the case of forming the color image. Thus, in order to control so that the values of the current flowing to the control motor 16 become equal to each other when the black and white image is formed and when the color image is formed, the current control part 120-2 conducts a velocity control which will be described in the following, and increases the frictional force with respect to the transfer belt 33 (the load torque with respect to the control motor 16).

In an aspect, the current control part 120-2 increases the frictional force acting to the transfer belt 33 of the photoreceptor 1B for black, by controlling the control motor 14B rotationally driving the photoreceptor 1B for black. In detail, the current control part 120-2 controls the control motor 14B, and makes the rotational velocity of the photoreceptor 1B for black be the predetermined velocity Vb which is slower than the rotational velocity in the case of forming the color image. The predetermined velocity Vb is determined by the torque of the control motor 16 and a range of allowable deterioration of image quality which is caused by making the rotational velocity of the photoreceptor 1B for black slower. By this control, it is possible to increase the frictional force acting to the transfer belt 33 (load torque with respect to the control motor 16) by the photoreceptor 1B in the transfer device 3B.

Moreover, in the sub-scan direction of the toner image formed on the photoreceptor 1B for black, the shrinkage caused by making the rotational velocity of the photoreceptor 1B for black slower is offset (enlarged) when the toner image is transferred onto the printing medium P. Thus, the toner image transferred onto the printing medium P becomes the desired image. Alternatively, in this aspect, the current control part 120-2 may control the control motor 14B, and may make the rotational velocity of the photoreceptor 1B for black be the predetermined velocity Vb which is faster than the rotational velocity in the case of forming the color image. In this case, in the sub-scan direction of the toner image formed on the photoreceptor 1B for black, the elongation caused by making the rotational velocity of the photoreceptor 1B for black faster is offset (shrunk) when the toner image is transferred onto the printing medium P.

Moreover, in another aspect, the current control part 120-2 increases the frictional force acting to the transfer belt 33 by the photoreceptor 1B for black, by controlling the control motor 16 rotationally driving the transfer belt 33 and the control motor 41 rotationally driving the polygon mirror 42. In detail, the current control part 120-2 controls the control motor 16, and makes the rotational velocity of the transfer belt 33 be the predetermined velocity Vm which is faster than the rotational velocity in the case of forming the color image. Simultaneously, the current control part 120-2 controls the control motor 41, and makes the rotational velocity of the polygon mirror 42 be a predetermined velocity Vp' which is slower than the rotational velocity in the case of forming the color image. The predetermined velocities Vm and Vp' are determined by the torque of the control motor 16 and a range of allowable deterioration of image quality which is caused by making the rotational velocity of the transfer belt 33 faster. By this control, it is possible to increase the frictional force acting to the transfer belt 33 by the photoreceptor 1B for black (the load torque with respect to the control motor 16).

Moreover, in the sub-scan direction of the toner image which is to be transferred onto the printing medium P, the elongation caused by making the rotational velocity of the transfer belt 33 faster is offset (shrunk) by making the scan velocity of the polygon mirror 42 faster. Thus, the toner image transferred onto the printing medium P becomes the desired image. Also, in a relationship between the predetermined velocities Vm and Vp, absolute values of change rates, in which each of the rotational velocities in the case of forming the color image is set as a reference, are equal to each other.

Each of the image forming apparatuses 100 and 100-2 includes a CPU (Central Processing Unit), a ROM (Read-Only Memory), a RAM (Random Access Memory), and an HDD (Hard Disk Drive). The CPU is a device to execute programs. The ROM is a device to store the programs and data to be executed by the CPU. The RAM is a device to develop (load) the programs and the data when the CPU executes the programs and to temporarily retain operation data during an operation. The HDD is a device to store an OS (Operating System) being basic software, application programs, and a like according to this embodiment with related data.

Process parts included in each of the image forming apparatuses 100 and 100-2 can be realized by the CPU executing respective programs stored in the ROM or HDD. Alternatively, the process parts may be realized by hardware.

<Process Example (Part 1) by Image Forming Apparatus>

Figure 4:
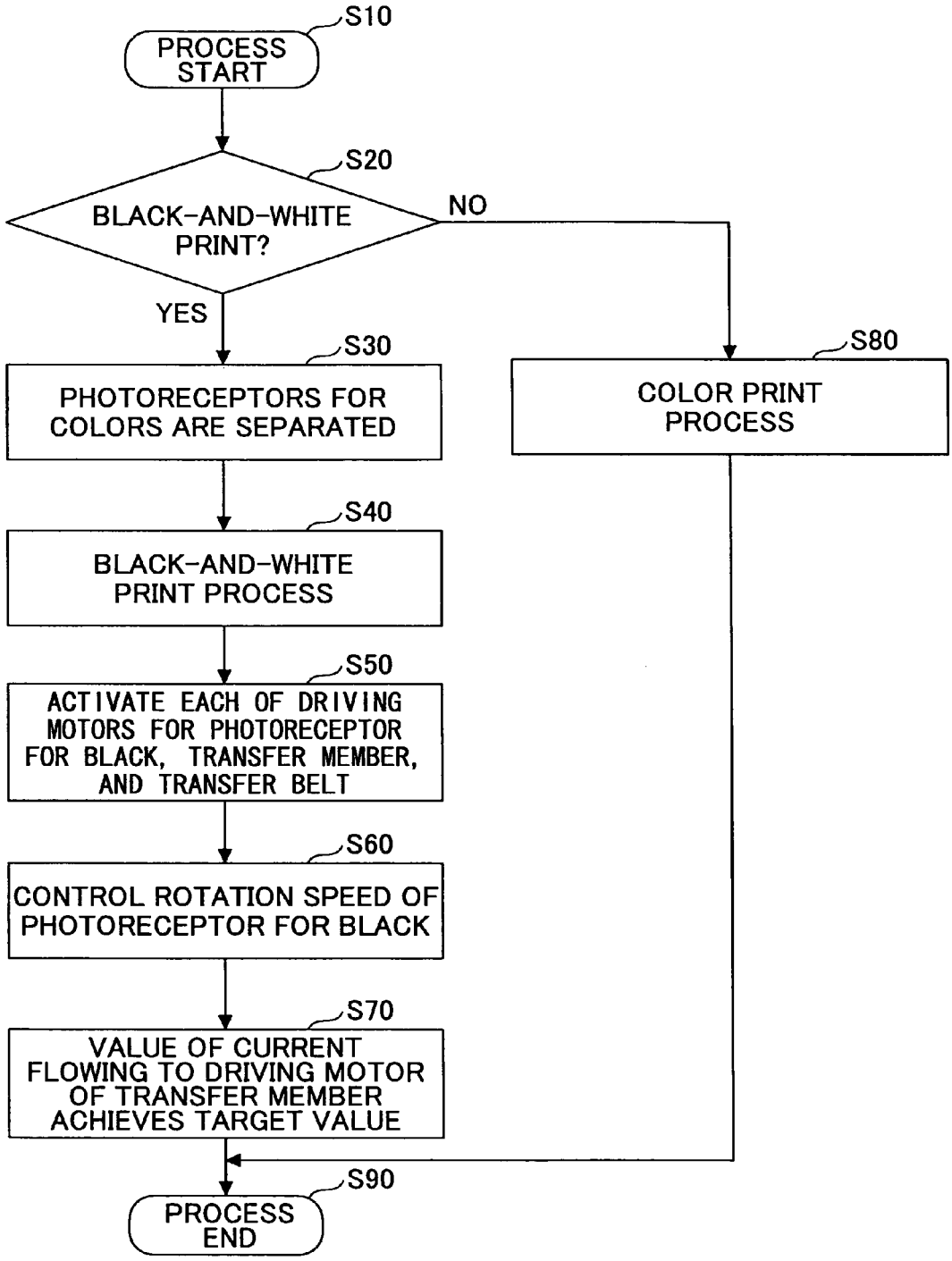
FIG. 4 is a flowchart for explaining a process example (part 1) by the image forming apparatus according to the embodiment.

A process example (part 1) conducted by the image forming apparatus 100 according to the embodiment will be described with reference to FIG. 4. FIG. 4 is a flowchart for explaining the process example (part 1) by the image forming apparatus 100. Since a process conducted by the image forming apparatus 100-2 of the direct transfer system is similar to the process conducted by the image forming apparatus 100 of the intermediate transfer system, the process example (part 1) will be described mainly for the image forming apparatus 100. In FIG. 4, in a case of the intermediate transfer system, the current control part 120 controls the value of the current flowing to the control motor 15 by using the rotational velocity of the photoreceptor 1B for black as a parameter. In a case of the direct transfer system, the current control part 120-2 controls the value of the current flowing to the control motor 16 by using the rotational velocity of the photoreceptor 1B for black as a parameter.

In step S10, the image forming apparatus 100 begins a print process. In step S20, it is determined whether or not the print process (of which an execution request is made) to be conducted by the image forming part 110 is a black and white print process. When the print process is a black and white print (Yes in the step S20), in step S30, the image forming part 110 separates the photoreceptors 1Y, 1C, and 1M for colors from the intermediate transfer member 5. In the case of the direct transfer system, the image forming apparatus 110-2 separates the photoreceptors 1Y, 1C, and 1M for colors from the transfer belt 33.

In step S40, the image forming part 110 conducts the black and white print process with respect to image data to which the execution request is made, while conducting a control as described in step S50 through step S70. In the step S50, the image forming part 110 drives the control motor 14B driving the photoreceptor 1B for black, the control motor 15 driving the intermediate transfer member 5, and the control motor 17 driving the transfer belt 33. In the case of the direct transfer system, the image forming apparatus 110-2 drives the control motor 14B driving the photoreceptor 1B for black, and the control motor 16 driving the transfer belt 33.

In step S60, the current control part 120 controls the control motor 14B, and changes the rotational velocity of the photoreceptor 1B for black to the predetermined velocity Vb. The predetermined velocity Vb is a velocity slower than the rotational velocity in the case of forming the color image, and is determined by the torque of the control motor 15 or the control motor 16 and the range of allowable deterioration of image quality which is caused by making the rotational velocity of the photoreceptor 1B for black slower. Alternatively, the predetermined velocity Vb may be a velocity slower than the rotational velocity in the case of forming the color image.

Subsequently, in the step S70, the current control part 120 controls so that the value of the current flowing to the control motor 15 driving the intermediate transfer member 5 is equal to the value of the current flowing to the control motor 15 in the case of forming the color image. In the case of the direct transfer system, the current control part 120-2 controls so that the value of the current flowing to the control motor 16 driving the transfer belt 33 is equal to the value of the current flowing to the control motor 16 in the case of forming the color image. Thus, in step S90, the image forming part 110 terminates the black and white print process.

When it is determined that the print process (of which the execution request is made) to be executed by the image forming part 110 is a color print (No in the step S20), in the step S80, the image forming part 110 conducts the color print process with respect to image data of which the execution request is made, and executes the color print process. Then, in step S90, the image forming part 110 terminates the color print process.

As described above, by making the rotational velocity of the photoreceptor 1B for black slower (faster), a contact resistance with the intermediate transfer member 5 can be increased (decreased). Therefore, even in the case of forming the black and white image, it is possible to stably drive the control motor 15 of the intermediate transfer member 5. In the case of the direct transfer system, by making the rotational velocity of the photoreceptor 1B for black slower (faster), it is possible to increase (decrease) a contact resistance with the transfer belt 33. Therefore, even in the case of forming the black and white image, it is possible to stably drive the control motor 16 of the transfer belt 33.

<Process Example (Part 2) by Image Forming Apparatus>

Figure 5:
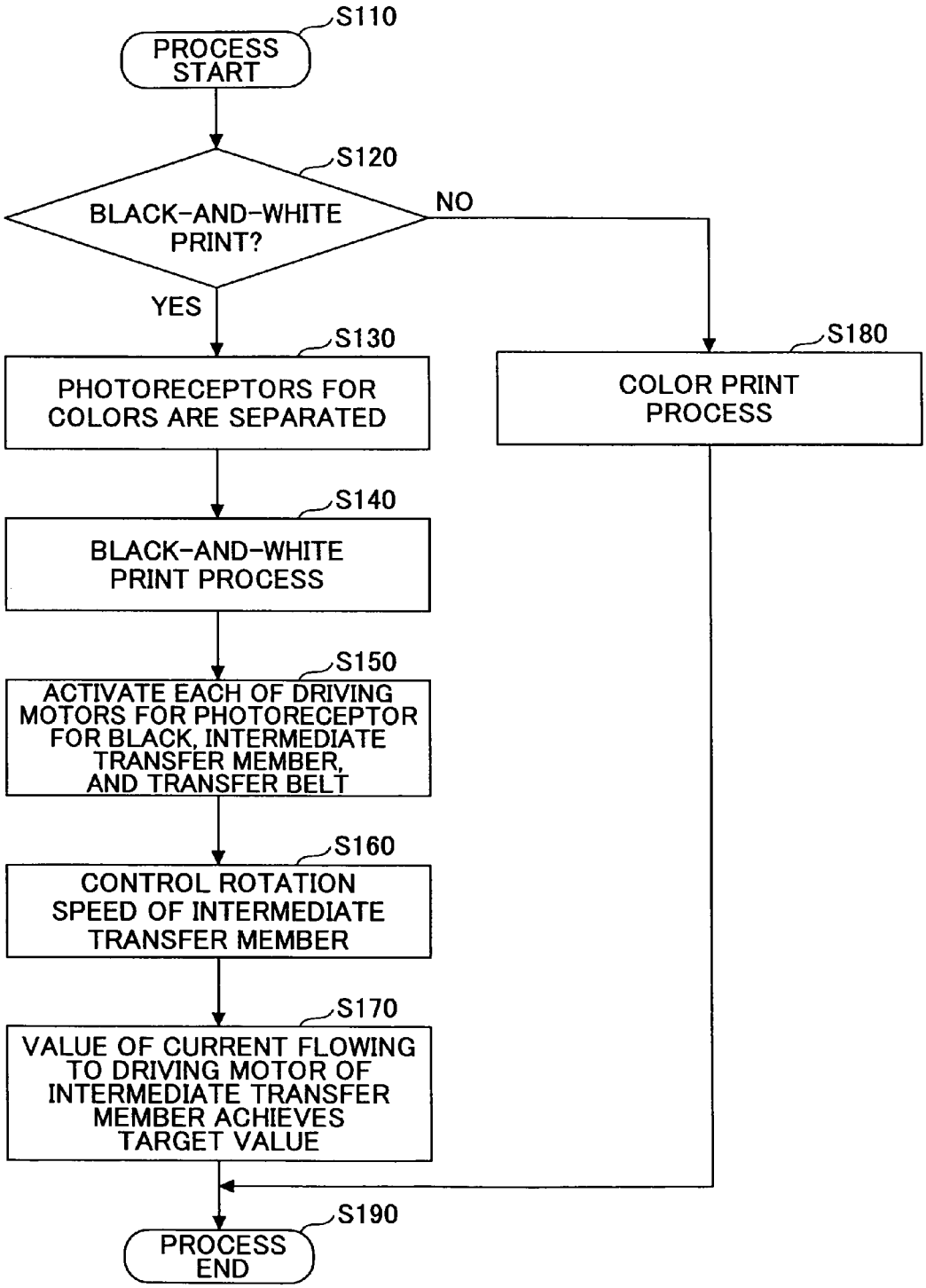
FIG. 5 is a flowchart for explaining a process example (part 2) by the image forming apparatus according to the embodiment.

A process example (part 2) conducted by the image forming apparatus 100 according to the embodiment will be described with reference to FIG. 5. FIG. 5 is a flowchart for explaining the process example (part 2) by the image forming apparatus 100. Since a process conducted by the image forming apparatus 100-2 of the direct transfer system is similar to the process conducted by the image forming apparatus 100 of the intermediate transfer system, the process example (part 2) will be described mainly for the image forming apparatus 100.

In FIG. 5, in the case of the intermediate transfer system, the current control part 120 controls the value of the current flowing to the control motor 15 by using the rotational velocity of the intermediate transfer member 5 as a parameter. In a case of the direct transfer system, the current control part 120-2 controls the value of the current flowing to the control motor 16 by using the rotational velocity of the transfer belt 33 as a parameter.

In step S110, the image forming apparatus 100 begins the print process. In step S120, it is determined whether or not the print process (of which the execution request is made) to be executed by the image forming part 110 is a black and white print process. When the print process is a black and white print (Yes in the step S120), in step S130, the image forming part 110 separates the photoreceptors 1Y, 1C, and 1M for colors from the intermediate transfer member 5. In the case of the direct transfer system, the image forming apparatus 110-2 separates the photoreceptors 1Y, 1C, and 1M for colors from the transfer belt 33.

In step S140, the image forming part 110 executes the black and white print process with respect to image data to which the execution request is made while conducting a control which will be described in step S150 through step S170. In the step S150, the image forming part 110 drives the control motor 14B driving the photoreceptor 1B for black, the control motor 15 driving the intermediate transfer member 5, and the control motor 17 driving the transfer belt 33. In the case of the direct transfer system, the image forming apparatus 110-2 drives the control motor 14B driving the photoreceptor 1B for black, and the control motor 16 driving the transfer belt 33.

In step S160, the current control part 120 controls the control motor 15, and changes the rotational velocity of the intermediate transfer member 5 to the predetermined velocity Vm. In the case of the direct transfer system, the image forming apparatus 110-2 controls the control motor 16 and the changes the rotational velocity of the transfer belt 33 to the predetermined velocity Vm. The predetermined velocity Vm is a velocity faster than the rotational velocity in the case of forming the color image, and is determined by the torque of the control motor 15 or the control motor 16 and the range of allowable deterioration of image quality which is caused by making the rotational velocity of the intermediate transfer member 5 or the transfer belt 33 faster.

In the case of the direct transfer system, the current control part 120 makes the rotational velocity of the transfer belt 33 be the predetermined velocity Vm. Simultaneously, the current control part 120 controls the control motor 41, and makes the rotational velocity of the polygon mirror 42 be the predetermined velocity Vp' which is slower than the rotational velocity in the case of forming the color image. The predetermined velocity Vp' is determined by the torque of the control motor 16 and the range of allowable deterioration of image quality which is caused by making the rotational velocity of the transfer belt 33 faster.

Subsequently, in step S170, the current control part 120 controls so that the value of the current flowing to the control motor 15 driving the intermediate transfer member 5 is equal to the value of the current flowing to the control motor 15 in the case of forming the color image. In the case of the direct transfer system, the current control part 120-2 controls so that the value of the current flowing to the control motor 16 driving the transfer belt 33 is equal to the value of the current flowing to the control motor 16 in the case of forming the color image. Thus, in step S190, the image forming part 110 terminates the black and white print process.

When it is determined that the print process (of which the execution request is made) to be executed by the image forming part 110 is a color print (No in the step S120), in the step S180, the image forming part 110 conducts the color print process with respect to image data of which the execution request is made, and executes the color print process. Then, in step S190, the image forming part 110 terminates the color print process.

As described above, by making the rotational velocity of the intermediate transfer member 5 faster, a contact resistance between the photoreceptor 1B for black and the intermediate transfer member 5 can be increased. Therefore, even in the case of forming the black and white image, it is possible to stably drive the control motor 15 of the intermediate transfer member 5. In the case of the direct transfer system, by making the rotational velocity of the transfer belt 33 faster, it is possible to increase a contact resistance between the photoreceptor 1B for black and the transfer belt 33. Therefore, even in the case of forming the black and white image, it is possible to stably drive the control motor 16 of the transfer belt 33.

<Process Example (Part 3) by Image Forming Apparatus>

Figure 6:
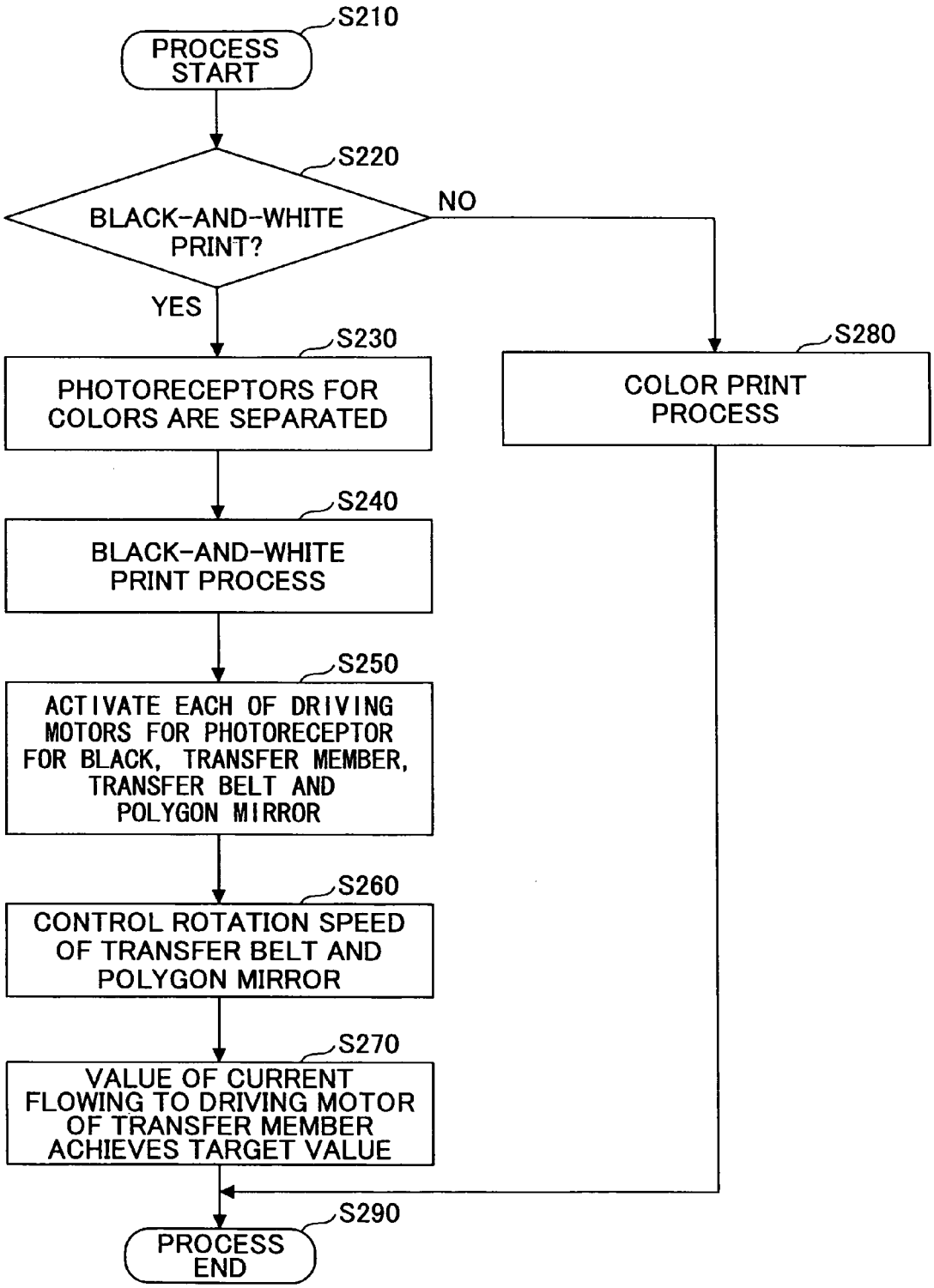
FIG. 6 is a flowchart for explaining a process example (part 3) by the image forming apparatus according to the embodiment.

A process example (part 3) conducted by the image forming apparatus 100 according to the embodiment will be described with reference to FIG. 6. FIG. 6 is a flowchart for explaining the process example (part 3) by the image forming apparatus 100. In FIG. 6, the current control part 120 controls the value of the current flowing to the control motor 15 by using the rotational velocity of the transfer belt 33 as a parameter.

In step S210, the image forming apparatus 100 begins a print process. In step S220, it is determined whether or not the print process (of which an execution request is made) to be conducted by the image forming part 110 is a black and white print process. When the print process is a black and white print (Yes in the step S220), in step S230, the image forming part 110 separates the photoreceptors 1Y, 1C, and 1M for colors from the intermediate transfer member 5.

In step S240, the image forming part 110 executes the black and white print process with respect to image data to which the execution request is made while conducting a control which will be described in step S250 through step S270. In the step S250, the image forming part 110 drives the control motor 14B driving the photoreceptor 1B for black, the control motor 15 driving the intermediate transfer member 5, the control motor 17 driving the transfer belt 33, and the control motor 41 driving the polygon mirror 42.

In the step S260, the current control part 120 changes the rotational velocity of the polygon mirror 42 to the predetermined velocity Vp, by controlling the control motor 17 and the control motor 41, and changing the rotational velocity of the transfer belt 33 to the predetermined velocity Vs. The predetermined velocity Vs is a velocity slower than the rotational velocity in the case of forming the color image, and the predetermined velocity Vp is a velocity faster than the rotational velocity in the case of forming the color image. The predetermined velocities Vs and Vp are determined by the torque of the control motor 15 and the range of allowable deterioration of image quality which is caused by making the rotational velocity of the transfer belt 33 slower. In a relationship between the predetermined velocities Vs and Vp, absolute values of change rates, in which each of the rotational velocities in forming the color image is set as a reference, are equal to each other. Alternatively, the predetermined velocity Vs may be faster than the rotational velocity in the case of forming the color image. Simultaneously, the predetermined velocity Vp may be slower than the rotational velocity in the case of forming the color image.

Subsequently, in the step S270, the current control part 120 controls so that the value of the current flowing to the control motor 15 driving the intermediate transfer member 5 is equal to the value of the current flowing to the control motor 15 in the case of forming the color image. Thus, in step S290, the image forming part 110 terminates the black and white print process.

When it is determined that the print process (of which the execution request is made) to be executed by the image forming part 110 is a color print (No in the step S220), in the step S280, the image forming part 110 conducts the color print process with respect to image data of which the execution request is made, and executes the color print process. Then, in step S290, the image forming part 110 terminates the color print process.

As described above, by making the rotational velocity of the transfer belt 33 for conducing the secondary transfer slower (faster), the contact resistance with the intermediate transfer member 5 can be increased (decreased) Accordingly, it is possible to stably drive the control motor 15 driving the intermediate transfer member 5.

<Process Example (Part 4) by Image Forming Apparatus>

Figure 7:
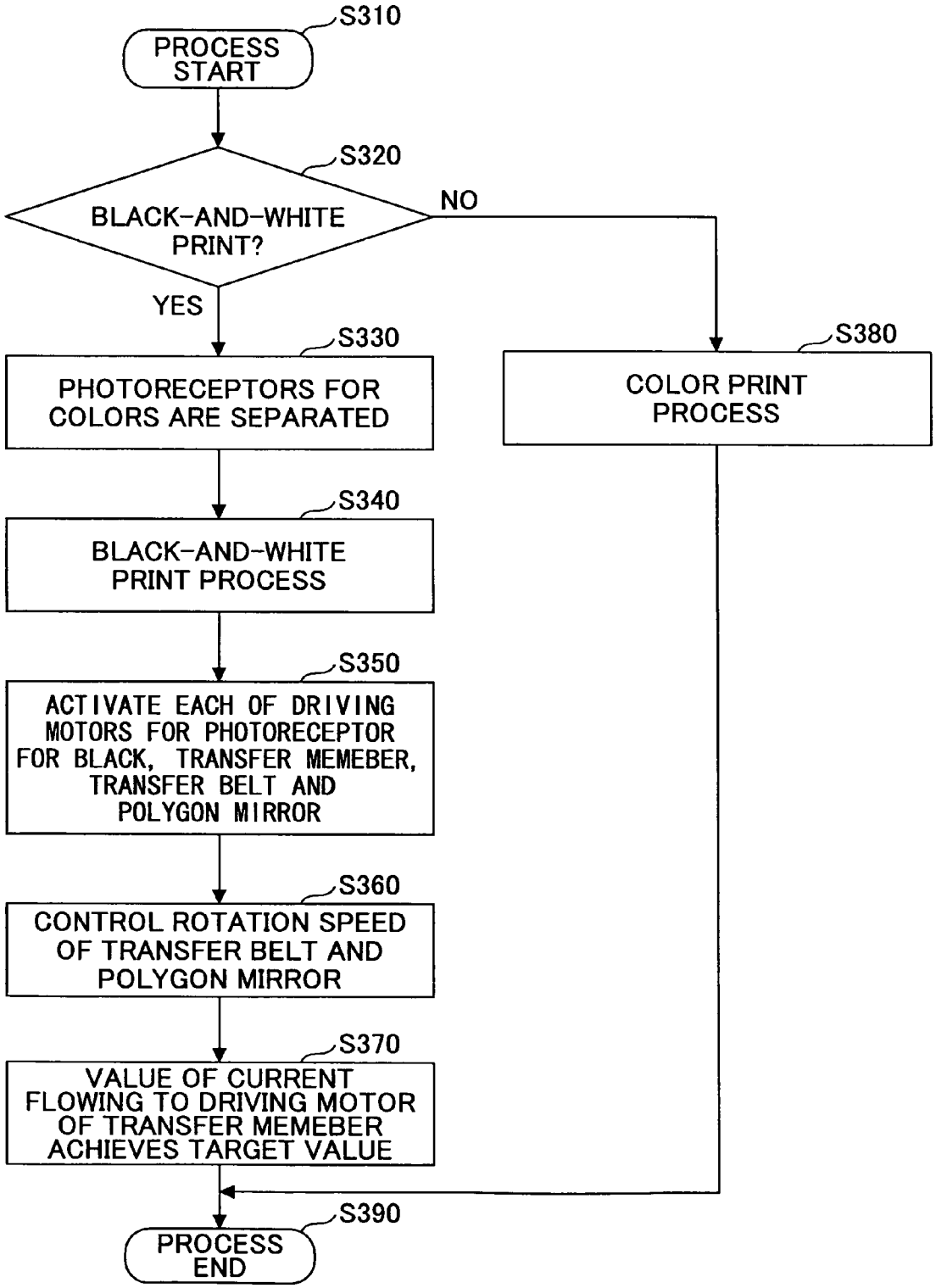
FIG. 7 is a flowchart for explaining a process example (part 4) by the image forming apparatus according to the embodiment.

A process example (part 4) conducted by the image forming apparatus 100 according to the embodiment will be described with reference to FIG. 7. FIG. 7 is a flowchart for explaining the process example (part 4) by the image forming apparatus 100. In FIG. 7, the current control part 120 controls the value of the current flowing to the control motor 15 by using the rotational velocity of the driven roller 22 as a parameter.

In step S310, the image forming apparatus 100 begins a print process. In step S320, it is determined whether or not the print process (of which an execution request is made) to be conducted by the image forming part 110 is a black and white print process. When the print process is a black and white print (Yes in the step S320), in step S330, the image forming part 110 separates the photoreceptors 1Y, 1C, and 1M for colors from the intermediate transfer member 5.

In step S340, the image forming part 110 conducts the black and white print process with respect to image data to which the execution request is made, while conducting a control as described in step S350 through step S370. In the step S350, the image forming part 110 drives the control motor 14B driving the photoreceptor 1B for black, the control motor 15 driving the intermediate transfer member 5, and the control motor 17 driving the transfer belt 33.

In step S360, the current control part 120 controls the control motor 31, and applies a load (brake) to the rotation of the driven roller 22. Also, the control motor 31 may be directly connected to the driven roller 22. Alternatively, in order to be approximately the same as the load torque of the control motor 15 in the case of forming the color image, the control motor 31 may be connected to the driven roller 22 through the gear 30. Moreover, the current control part 120 increases the load torque which the control motor 15 receives, to be the same level in the case of forming the color image.

Subsequently, in the step S370, the current control part 120 controls so that the value of the current flowing to the control motor 15 driving the intermediate transfer member 5 is equal to the value of the current flowing to the control motor 15 in the case of forming the color image. Thus, in step S390, the image forming part 110 terminates the black and white print process.

When it is determined that the print process (of which the execution request is made) to be executed by the image forming part 110 is a color print (No in the step S320), in the step S380, the image forming part 110 conducts the color print process with respect to image data of which the execution request is made, and executes the color print process. Then, in step S390, the image forming part 110 terminates the color print process.

As described above, it is possible to stably drive the control motor 15 driving the intermediate transfer member 5 in the case of forming the black and white print process, by connecting the control motor 31 as a motor for a brake to the driven roller 22 as a drive shaft of the intermediate transfer member 5.

According to the present invention, even in the case of forming the black and white image in which the photoreceptors 1Y, 1C, and 1M for colors are separated from the intermediate transfer member 5 or the transfer belt 33, it is possible to provide the image forming apparatus 100 or 100-2 which can stably rotate and drive the motor 15 or 16 driving the intermediate transfer member 5 or the transfer belt 33 and can form a high quality image.

The present invention is not limited to the specifically disclosed embodiments, and variations and modifications may be made without departing from the scope of the invention.

The present application is based on the Japanese Priority Patent Applications No. 2008-200038 filed Aug. 1, 2008 and No. 2009-168442 filed Jul. 17, 2009, the entire contents of which are hereby incorporated by reference.

What is claimed is:

1. A tandem-type image forming apparatus including a photoreceptor for black which is rotatable, a plurality of photoreceptors for colors which is rotatable, an intermediate transfer member or a transfer belt, the intermediate transfer member which is an endless belt shape and transfers a toner image formed on the photoreceptors, the transfer belt which is an endless belt shape and carries a printing medium to transfer the toner image, and a motor which drives the intermediate transfer member or the transfer belt, in which the photoreceptor for black and the plurality of the photoreceptors for colors are controlled to be contacted to the intermediate transfer member or the transfer belt in a case of forming a color image, and in which the photoreceptor for black is controlled to be contacted to the intermediate transfer member or the transfer belt and the plurality of the photoreceptors for colors are controlled to be separated from the intermediate transfer member or the transfer belt in a case of forming a black and white image, said tandem-type image forming apparatus comprising:

a current control part configured to control so that in the case of forming the black and white image, when the intermediate transfer member or the transfer belt is driven, a value of a current flowing to the motor is equal to the value of the current in the case of forming the color image, wherein the current control part controls the value of the current by controlling a rotational velocity of the photoreceptor for black.

2. The image forming apparatus as claimed in claim 1, wherein the current control part decreases the rotational velocity of the photoreceptor for black to be slower than the rotational velocity of the photoreceptor for black in the case of forming the color image.

3. The image forming apparatus as claimed in claim 1, wherein the current control part increases the rotational velocity of the photoreceptor for black to be faster than the rotational velocity of the photoreceptor for black in the case of forming the color image.

4. A tandem-type image forming apparatus including a photoreceptor for black which is rotatable, a plurality of photoreceptors for colors which is rotatable, an intermediate transfer member which is an endless belt shape and transfers a toner image formed on the photoreceptors, a motor which drives the intermediate transfer member, a polygon mirror which is rotatable and reflects a laser light to scan the photoreceptors and to form an electrostatic latent image on the photoreceptors, and a transfer belt which caries a printing medium when the toner image transferred onto the intermediate transfer member is secondarily transferred onto the printing medium, in which the photoreceptor for black and the plurality of the photoreceptors for colors are controlled to be contacted to the intermediate transfer member in a case of forming a color image, and in which the photoreceptor for black is controlled to be contacted to the intermediate transfer member and the plurality of the photoreceptors for colors are controlled to be separated from the intermediate transfer member in a case of forming a black and white image, said tandem-type image forming apparatus comprising:

a current control part configured to control so that in the case of forming the black and white image, when the intermediate transfer member is driven, a value of a current flowing to the motor is equal to the value of the current in the case of forming the color image, wherein the current control part controls the value of the current by controlling a transfer velocity of the transfer belt and a rotational velocity of the polygon mirror.

5. The image forming apparatus as claimed in claim 4, wherein the current control part decreases the transfer velocity of the transfer belt to be slower then the transfer velocity of the transfer belt in the case of forming the color image and increases the rotational velocity of the polygon mirror to be faster than the rotational velocity of the polygon mirror in the case of forming the color image.

6. The image forming apparatus as claimed in claim 4, wherein the current control part increases the transfer velocity of the transfer belt to be faster then the transfer velocity of the transfer belt in the case of forming the color image and decreases the rotational velocity of the polygon mirror to be slower than the rotational velocity of the polygon mirror in the case of forming the color image.

7. A tandem-type image forming apparatus including a photoreceptor for black which is rotatable, a plurality of photoreceptors for colors which is rotatable, a transfer belt which is an endless belt shape and carries a printing medium to transfer a toner image formed on the photoreceptors, a motor which drives the transfer belt, and a polygon mirror which is rotatable and reflects a laser light to scan the photoreceptors and to form an electrostatic latent image on the photoreceptors, in which the photoreceptor for black and the plurality of the photoreceptors for colors are controlled to be contacted to the transfer belt in a case of forming a color image, and in which the photoreceptor for black is controlled to be contacted to the transfer belt and the plurality of the photoreceptors for colors are controlled to be separated from the transfer belt in a case of forming a black and white image, said tandem-type image forming apparatus comprising:

a current control part configured to control so that in the case of forming the black and white image, when the transfer belt is driven, a value of a current flowing to the motor is equal to the value of the current in the case of forming the color image, wherein the current control part controls the value of the current by controlling a driving velocity of the transfer belt by the motor and a rotational velocity of the polygon mirror.

8. The image forming apparatus as claimed in claim 7, wherein the current control part decreases the driving velocity of the transfer belt to be slower than the driving velocity of the transfer belt in the case of forming the color image, and increases the rotational velocity of the polygon mirror to be faster than the rotation velocity of the polygon mirror in the case of forming the color image.

9. The image forming apparatus as claimed in claim 7, wherein the current control part increases the driving velocity of the transfer belt to be faster than the driving velocity of the transfer belt in the case of forming the color image, and decreases the rotational velocity of the polygon mirror to be slower than the rotation velocity of the polygon mirror in the case of forming the color image.

10. A tandem-type image forming apparatus including a photoreceptor for black which is rotatable, a plurality of photoreceptors for colors which is rotatable, at least one of an intermediate transfer member and a transfer belt, the intermediate transfer member which is an endless belt shape and transfers a toner image formed on the photoreceptors, the transfer belt which is an endless belt shape and carries a printing medium to transfer the toner image, a motor which drives the at least one of intermediate transfer member and the transfer belt, in which the photoreceptor for black and the plurality of the photoreceptors for colors are controlled to be contacted to the at least one of intermediate transfer member and the transfer belt in a case of forming a color image, and in which the photoreceptor for black is controlled to be contacted to the at least one of intermediate transfer member and the transfer belt and the plurality of the photoreceptors for colors are controlled to be separated from the at least one of intermediate transfer member and the transfer belt in a case of forming a black and white image, said tandem-type image forming apparatus comprising:

a current control part configured to control so that in the case of forming the black and white image, when the at least one of the intermediate transfer member and the transfer belt is driven, a value of a current flowing to the motor is equal to the value of the current in the case of forming the color image, wherein the current control part controls the value of the current by controlling at least one of a rotational velocity of the photoreceptor for black and a velocity of the transfer belt.

* * * * *

UNITED STATES PATENT AND TRADEMARK OFFICE

CERTIFICATE OF CORRECTION

PATENT NO. : 8,200,133 B2
APPLICATION NO. : 12/461155
DATED : June 12, 2012
INVENTOR(S) : Hiroyuki Iwasaki It is certified that error appears in the above-identified patent and that said Letters Patent is hereby corrected as shown below:

On the Title page, Item (73), should read:

(73) Assignee: Ricoh Company, Ltd., Tokyo (JP)

Signed and Sealed this
Twentieth Day of November, 2012

David J. Kappos

David J. Kappos
*Director of the United States Patent and Trademark Office*